US008979470B2

(12) United States Patent
Riazantsev et al.

(10) Patent No.: US 8,979,470 B2
(45) Date of Patent: Mar. 17, 2015

(54) GAS TURBINE ENGINE AND METHOD FOR COOLING THE COMPRESSOR OF A GAS TURBINE ENGINE

(75) Inventors: Sergei Riazantsev, Nussbaumen (CH); Holger Kiewel, Brugg (CH); Sven Olmes, Windisch (CH); Thomas Kramer, Ennetbaden (CH); Sergey Shchukin, Mellingen (CH)

(73) Assignee: Alstom Technology Ltd., Baden (CH)

( * ) Notice: Subject to any disclaimer, the term of this patent is extended or adjusted under 35 U.S.C. 154(b) by 827 days.

(21) Appl. No.: 13/197,840

(22) Filed: Aug. 4, 2011

(65) Prior Publication Data

US 2012/0036864 A1 Feb. 16, 2012

(30) Foreign Application Priority Data

Aug. 10, 2010 (EP) ..... 10172376

(51) Int. Cl.

| | |
|---|---|
| ***F01D 5/08*** | (2006.01) |
| ***F01D 5/18*** | (2006.01) |
| ***F01D 5/30*** | (2006.01) |
| ***F04D 29/32*** | (2006.01) |
| ***F04D 29/58*** | (2006.01) |

(52) U.S. Cl.

CPC ..... *F01D 5/084* (2013.01); *F01D 5/3007* (2013.01); *F04D 29/321* (2013.01); *F04D 29/584* (2013.01); *F05D 2220/32* (2013.01)

USPC ..... 415/1; 415/115; 415/116; 415/175; 415/176

(58) Field of Classification Search

USPC ..... 415/1, 115, 116, 175, 176

See application file for complete search history.

(56) References Cited

U.S. PATENT DOCUMENTS

| | | | | |
|---|---|---|---|---|
| 3,647,313 | A * | 3/1972 | Koff | 415/115 |
| 4,719,747 | A | 1/1988 | Willkop et al. | |
| 4,795,307 | A * | 1/1989 | Liebl | 415/115 |
| 5,297,386 | A * | 3/1994 | Kervistin | 60/226.1 |
| 5,685,158 | A | 11/1997 | Lenahan et al. | |

FOREIGN PATENT DOCUMENTS

| | | | | |
|---|---|---|---|---|
| DE | 865773 | C | 2/1953 | |
| EP | 0170938 | A1 | 2/1986 | |
| EP | 0735255 | A1 | 10/1996 | |
| GB | 0789197 | A * | 1/1958 | F01D 5/08 |

OTHER PUBLICATIONS

European Search Report issued on Feb. 2, 2011, for European Application No. 10172376.5.

* cited by examiner

*Primary Examiner* — Igor Kershteyn

(74) *Attorney, Agent, or Firm* — Buchanan Ingersoll & Rooney PC

(57) ABSTRACT

A gas turbine engine includes a compressor with rotor blades having roots connected into seats of a compressor drum. The rotor blade roots and/or the compressor drum have longitudinal passages for a cooling fluid, connecting higher pressure areas to lower pressure areas of the gas turbine engine.

13 Claims, 5 Drawing Sheets

GAS TURBINE ENGINE AND METHOD FOR COOLING THE COMPRESSOR OF A GAS TURBINE ENGINE

RELATED APPLICATION

This application claims priority under 35 U.S.C. §119 to European Patent Application No. 10172376.5 filed in Europe on Aug. 10, 2010, the entire content of which is hereby incorporated by reference in its entirety.

FIELD

The present disclosure relates to a gas turbine engine and a method for cooling the compressor of a gas turbine engine.

BACKGROUND INFORMATION

Gas turbine engines are known to include a compressor wherein air is compressed to be then fed into a combustion chamber. Within the combustion chamber a fuel is injected into the compressed air and is combusted, generating high temperature and pressure flue gases that are expanded in a turbine.

A known gas turbine engine has a rotor shaft that carries at one end a compressor drum (carrying compressor rotor blades), and at the opposite end, turbine disks (carrying turbine rotor blades). The combustion chamber is provided between the compressor drum and the turbine disks.

The compressor drum has circumferential seats (shaped like circumferential dove tale slots) into which the compressor rotor blades are housed.

A casing is provided, which carries guide vanes for the compressor (compressor guide vanes) and for the turbine (turbine guide vanes).

The last stages of the compressor (where the air pressure is higher) can be thermally highly stressed.

The temperature of the compressed air at the outlet of the compressor can be high and the components at the last stages of the compressor can be cooled via cooling air injected into a gap between the compressor drum and the combustion chamber. The cooling air can be compressed air extracted downstream of the compressor before it enters the combustion chamber.

Therefore an equilibrium exists, which can allow a high lifetime for the parts concerned for the expected operating temperatures and stress, in particular, the compressor rotor, disk and blades that are the most stressed components of the compressor.

In order to increase power output and efficiency, it is desirable to increase the air mass flow through the compressor in order to increase the fuel mass flow that can be injected into the combustion chamber. This can increase the mass flow and temperature of the flue gases through the turbine.

Increasing the mass flow through the compressor can cause the temperature of the compressed air, for example, at the outlet of the compressor, to increase.

Such a temperature increase (tests showed that it could be as large as 20-30° C.) can influence the lifetime of the components affected.

With reference to FIG. 10 (curve A), the dependence of the lifetime of the parts, for example, the compressor, rotor, disk and blades, from the temperature of the compressed air at the compressor outlet is shown. From this diagram it is clear that also a small temperature increase (e.g., an increase of about 20-30° C.) can cause a large lifetime decrease. Such a lifetime decrease may not be acceptable, because it can cause the expected lifetime of the affected components to fall below the minimum admissible lifetime.

SUMMARY

A gas turbine engine is disclosed, comprising a compressor including a compressor drum and rotor blades having roots connected into seats of a compressor drum, wherein at least one of the rotor blade roots and the compressor drum include longitudinal passages for a cooling fluid, the longitudinal passages connecting higher pressure areas to lower pressure areas of the gas turbine engine.

A method is disclosed for cooling a compressor of a gas turbine engine, the compressor including a compressor drum and rotor blades having roots connected into seats of the compressor drum, the method comprising: forming at least one of the blade roots and the compressor drum with longitudinal passages for a cooling fluid, the longitudinal passages connecting higher pressure areas to lower pressure areas of the gas turbine engine; and passing a cooling fluid through the longitudinal passages.

BRIEF DESCRIPTION OF THE DRAWINGS

Further, characteristics and advantages of the disclosure will be more apparent from the description of exemplary embodiments of the gas turbine engine and method illustrated by way of non-limiting example in the accompanying drawings, in which.

DETAILED DESCRIPTION

Figure 1:
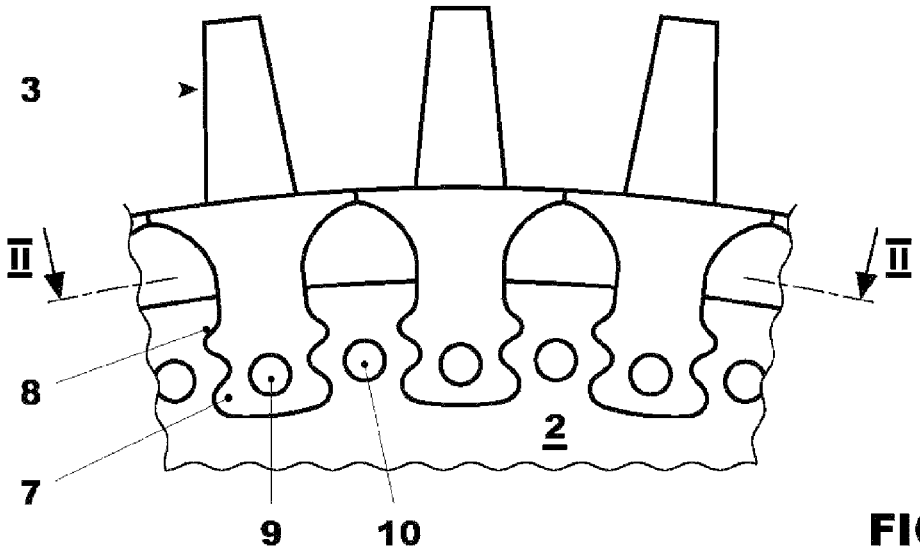
FIG. 1 is a schematic view of an exemplary embodiment of compressor rotor blades connected to a rotor drum.
Figure 2:
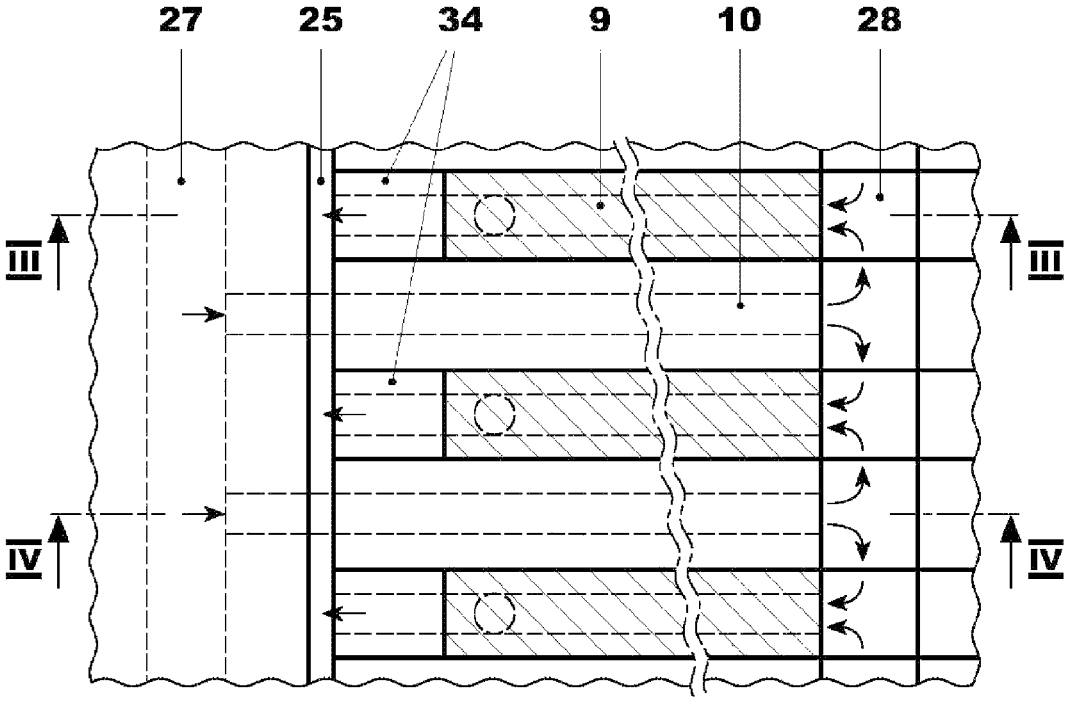
FIG. 2 is a schematic cross section through line II-II of FIG. 1.

The disclosure provides an engine and a method for allowing a gas turbine compressor to compress air until it reaches a temperature higher than in known gas turbines, without unacceptably reducing the lifetime of the components affected, for example, without unacceptably reducing the compressor rotor, disk and blade lifetime.

With reference to the figures, an exemplary gas turbine engine includes a compressor, one or more combustion chambers (according to the configuration), and a turbine. In different exemplary embodiments, the engine may also be a sequential combustion gas turbine engine and include a compressor, one or more combustion chambers (according to the configuration), a high pressure turbine, one or more further combustion chambers (according to the configuration), and a low pressure turbine.

The compressor 1 can be an axial compressor having a compressor drum 2 with compressor rotor blades 3 and compressor guide vanes 5.

The rotor blades 3 have roots 7 connected into seats 8 of the compressor drum 2.

As shown in FIG. 1, the blade roots 7 define longitudinal passages 9 and/or the compressor drum 2 defines longitudinal passages 10 for a cooling fluid. The longitudinal passages 9, 10 connect higher pressure areas 13 to lower pressure areas 14 of the gas turbine engine.

The differential pressure between the higher and lower pressure areas 13, 14 can allow cooling air circulation.

The seats 8 can be defined by longitudinal slots into which the blade roots 7 are inserted.

The passages 9 of the blade roots 7 can be defined by longitudinal channels 11 provided in the blade roots 7. All the blade roots 7 inserted into the same seat 8 have their channels connected together to define the passage 9 running over at least a portion of the compressor drum 2.

In a first exemplary embodiment (FIG. 9), the blades 3 have a structure with a platform 15 larger in the longitudinal direction (e.g., the direction of the passages 9) than the longitudinal size of the airfoil 16 carried by it. This can allow the rotor blades 3 to be directly connected one next to the other and, at the same time, can leave a gap between two next airfoils 16, for a guide vane 5.

In an exemplary embodiment, the rotor blades 3 have a structure with a platform 15 substantially as large in the longitudinal direction (e.g., in the direction of the passages 9) as the longitudinal size of the airfoils 16.

In this case spacers 18 between two adjacent blade roots 7 housed into the same seat 8 can be provided. The spacers 18 have a spacer root 19 and a platform 20 defining, with the platforms 15 of the blades 3, a compressed air path 22.

Also the spacer's roots 19 have longitudinal channels 23 that can be connected to the channels 11 of the blade roots 7 to define the longitudinal passages 9.

The higher and lower pressure areas can be defined in different positions of the engine.

For example, downstream of the compressor drum 2, a gap 25 separating it from a combustion chamber 26 can be provided.

Within this gap 25 a protrusion 27 can be provided, to close the compressed air path 22.

The higher pressure areas 13 can be defined between the protrusion 27 and the compressed air path 22 and the lower pressure areas 14 can be defined by areas of the gap 25 below the protrusion 27.

In an exemplary embodiment, the higher pressure areas 13 can be defined between the protrusion 27 and the compressed air path 22 (as in the embodiment above described), and the lower pressure areas 14 can be defined in the inside of a holed compressor drum 2.

The longitudinal passages 9, 10 can be provided over the whole compressor drum longitudinal length or only over a portion thereof. For example, the latter is desirable, because at the first stages of the compressor a large cooling may not be needed.

In order to connect the passages 9, 10 between the higher and lower pressure areas 13, 14, a circumferential chamber 28 extending at an intermediate position of the compressor drum 2 can be provided.

The circumferential chamber 28 can be connected to the longitudinal passages 9 of the blade roots 7 and/or to the longitudinal passages 10 of the compressor drum 2 (e.g., according to the particular cooing scheme).

In a exemplary embodiment, both longitudinal passages 9, 10 of the blade roots 7 and rotor drum 2 can be provided. These longitudinal passages 9, 10 have axes parallel to an engine longitudinal axis 30 and have the same radial distance from it.

The longitudinal passages 9 of the blade roots 7 can be connected to the lower pressure areas 14 and the longitudinal passages 10 of the compressor drum 2 can be connected to the higher pressure areas 13.

In the following, exemplary embodiments of the disclosure are described in detail with reference to the figures.

In a first exemplary embodiment (FIGS. 1 through 4), both the longitudinal passages 9, 10 of the blade roots 7 and compressor drum 2 are provided.

In this case, the passages 10 can be straight passages over their whole length (i.e., they are parallel to the engine longitudinal axis 30) and have one end opening in the high pressure areas 13 of the gap 25 and the opposite end opening in the circumferential chamber 28.

The longitudinal passages 9 have one end opening in the circumferential chamber 28 and extend straight (i.e., parallel to the axis 30) within the blade roots 7. Then, a terminal portion 32 provided within the compressor drum 2 is bent to the straight part and opens in the lower pressure areas 14 of the gap 25. In a exemplary embodiment, the bent portion 32 can be connected to a radial or bent portion 32*a* realised within the root 7 of the last blade 3 (i.e., the blade 3 that is closest to the combustion chamber 26).

In this embodiment, the seats 8 extend up to the border of the drum 2 facing the combustion chamber 26 and a locking element 34 is provided, to lock the blades 3 therein.

The operation of the compressor in this embodiment is the following.

Air passes through the compressed air path 22 and is compressed. Downstream of the compressor, a part of the compressed air is extracted and is cooled (in a cooler, not shown) to be then fed into the gap 25 as cooling air.

From the gap 25 (for example, its higher pressure areas 13) the cooling air enters the longitudinal passages 10 and passes through them reaching the circumferential chamber 28. This lets the compressor drum 2 be cooled.

Then from the circumferential chamber 28, the cooling air enters the longitudinal passages 9 of the blade roots 7 and passes through them, cooling them down.

From the longitudinal passage 9 of the last blade 3, the cooling air enters the portion 32*a* and then the bent terminal portion 32, to be discharged into the lower pressure areas 14 of the gap 25.

This embodiment allows cooling of the compressor drum 2 and rotor roots 7.

Figure 7:
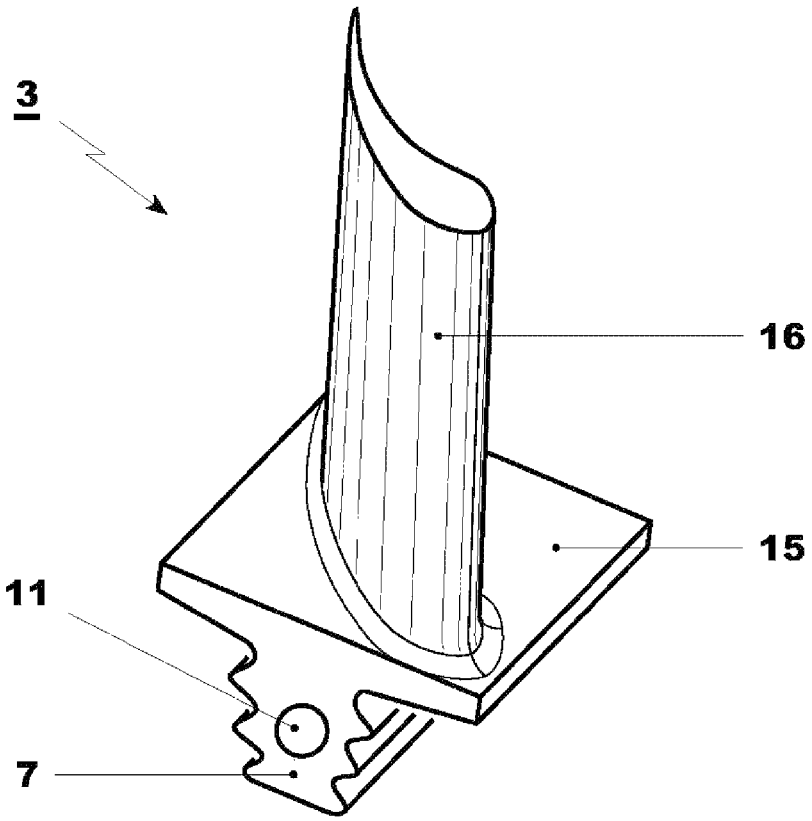
FIGS. 7 through 9 show respectively an exemplary embodiment of a compressor rotor blade, an exemplary embodiment of a compressor rotor spacer and an exemplary embodiment of compressor rotor blade.
Figure 8:
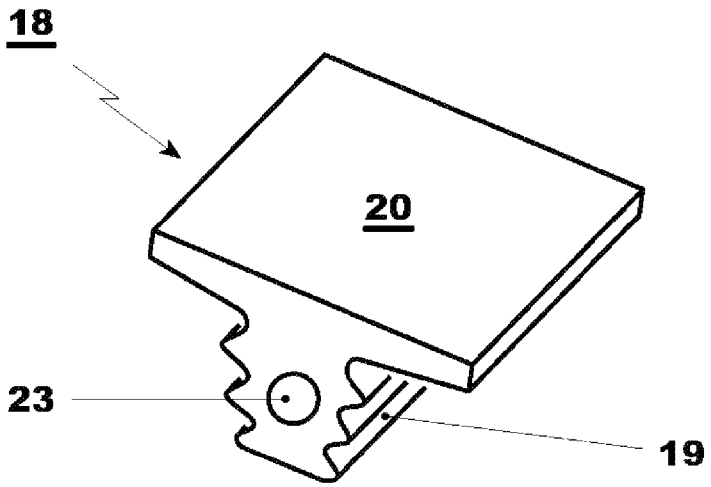
Figure 9:
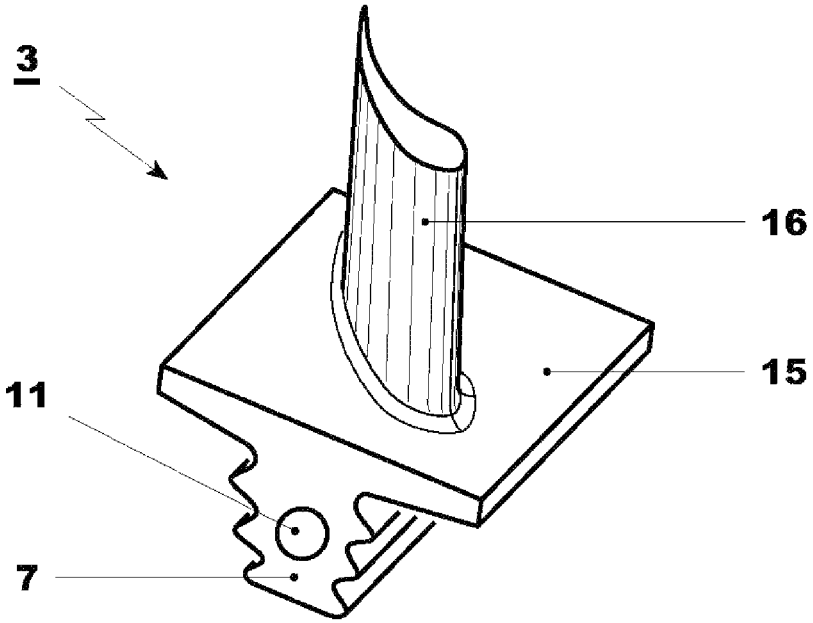

This embodiment may be implemented either with the rotor blades and spacers shown in FIGS. 7 and 8, or with the rotor blades shown in FIG. 9 or combination thereof.

Different embodiments in which the passages 9 are connected to the higher pressure areas 13 and the passages 10 are connected to the lower pressure areas 14 or embodiments implementing even further cooling schemes are possible.

In a second exemplary embodiment, only the longitudinal passages 9 of the rotor blades 7 are provided.

Figure 3:
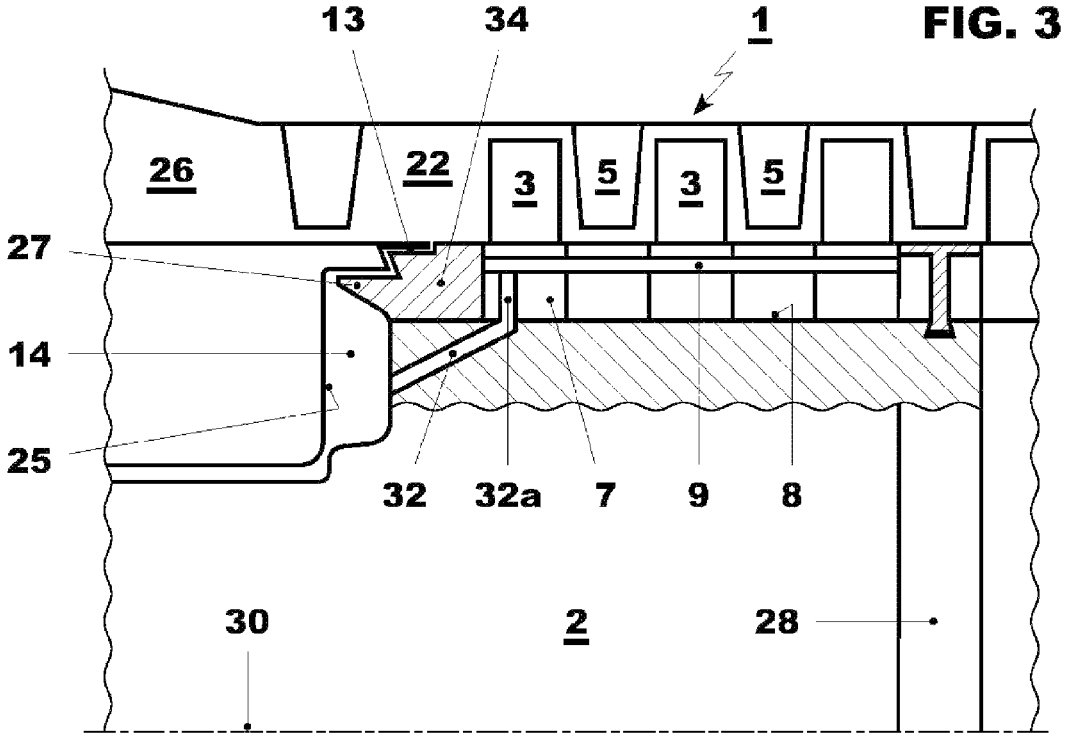
FIGS. 3 and 4 are cross sections respectively through lines III-III and IV-IV of FIG. 2.
Figure 4:
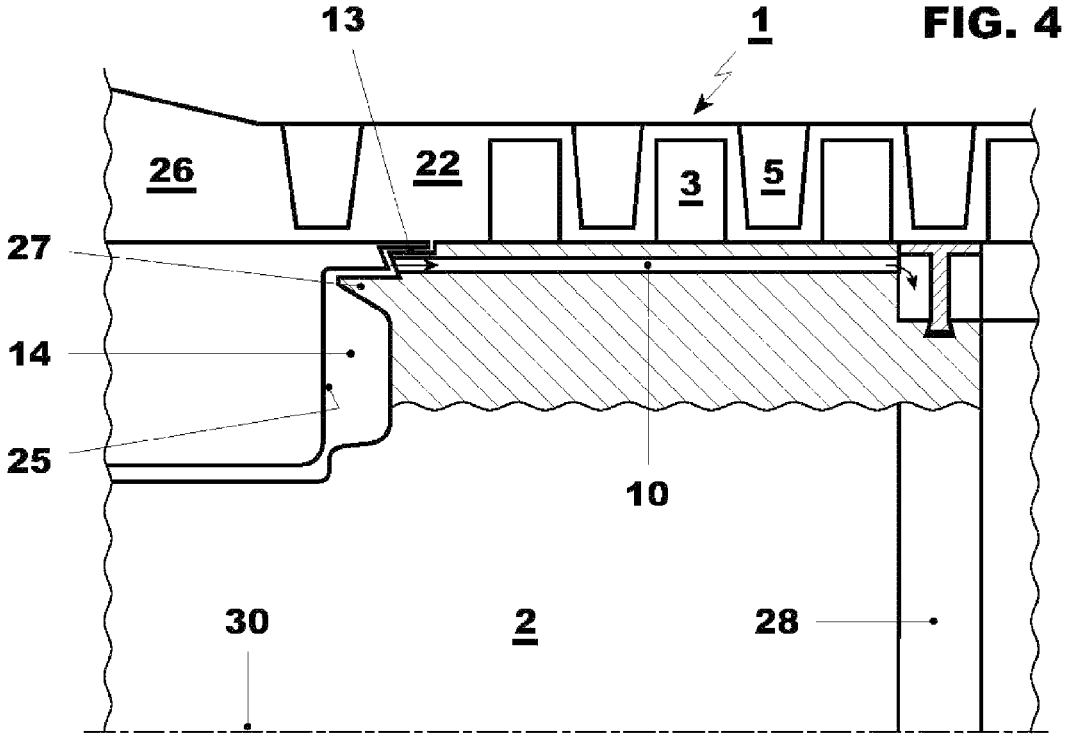
Figure 5:
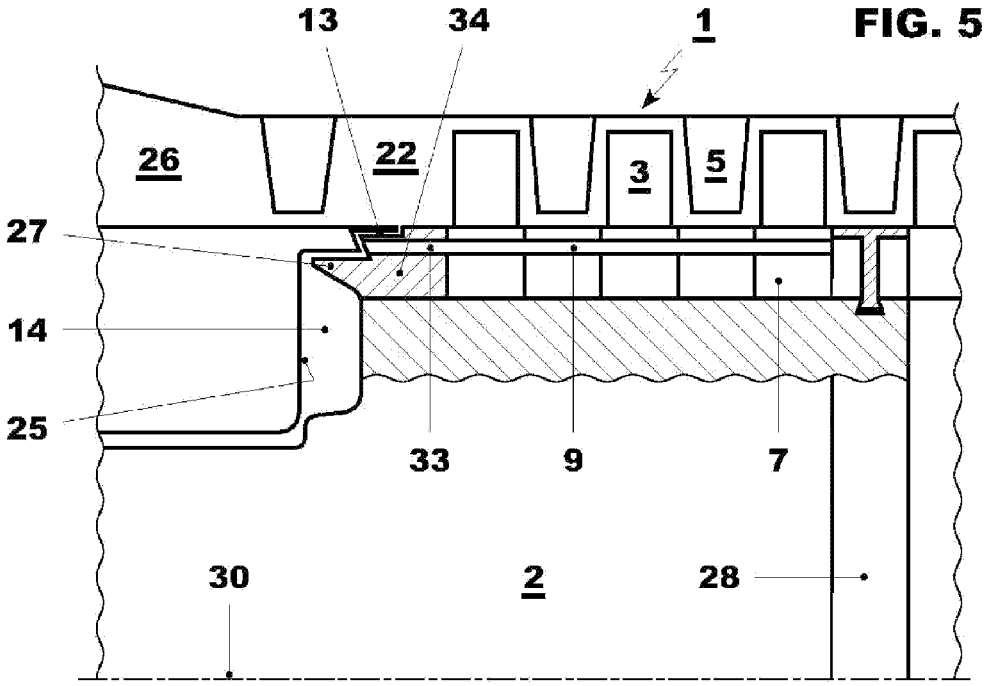
FIGS. 5 and 6 show different exemplary embodiments of root blade passages.

For example, in this case, some of the longitudinal passages 9 may have a bent terminal portion (as shown in FIG. 3) opening into the lower pressure areas 14 of the gap 25 and an opposite end opening in the circumferential chamber 28, and other passages 9 (see FIG. 5) may have an end opening in the circumferential chamber 28 and an opposite straight terminal portion 33 that may be realised within the locking element 34 (e.g., the terminal portion is not bent to the channels 11, but it is coaxial with them and parallel to the axis 30) opening in the higher pressure areas 13 of the gap 25.

The passages with bent terminal portions 32 can be alternated to passages with straight terminal portions 33.

This embodiment can be implemented either with the rotor blades and spacers shown in FIGS. 7 and 8, with the rotor blades shown in FIG. 9 or combination thereof.

This embodiment can be useful in case a limited cooling is desired. Additionally it can allow an easy machining.

In a third exemplary embodiment, only the passages 10 of the compressor drum 2 are provided.

Also in this case, some of the longitudinal passages 10 can have a bent terminal portion opening into the lower pressure areas 14 of the gap 25 and an opposite end opening in the circumferential chamber 28, and other longitudinal passages 10 can have an end opening in the circumferential chamber 28 and an opposite straight terminal portion opening in the higher pressure areas 13 of the gap 25. Passages with bent terminal portions can be alternated to passages with straight terminal portions.

This embodiment may be useful in case a limited cooling, for example, for the rotor drum 2, is desired.

The operation of the compressor in the second and third embodiments can be substantially the same as the first embodiment described and, with particular reference to the second embodiment, it is the following.

The cooling air enters into the passages 9 with straight terminal portion 33 and passes through them, cooling the roots 7 and the rotor drum 2, to then enter the circumferential chamber 28.

From the circumferential chamber 28 it enters the passages 9 having the bent terminal portion 32, to further cool the roots 7 and rotor drum 2.

Then the cooling air is discharged into the lower pressure areas 14 of the gap 25.

Figure 6:
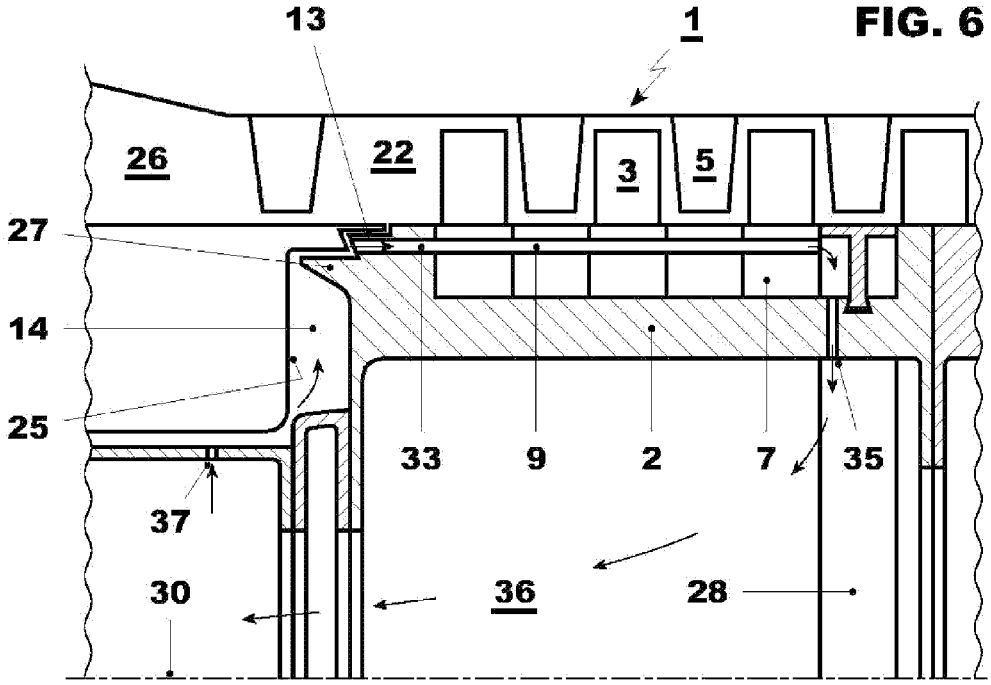

In exemplary embodiments (see FIG. 6), the compressor can have the passages 9 of the blades root, or the passages 10 of the compressor drum 2 or both the passages 9 and 10 that have a straight terminal portion opening in the higher pressure areas 13 of the gap 25 and an opposite end opening into the circumferential chamber 28.

The circumferential chamber 28 has a hole or duct 35 connecting it to the inside 36 of the rotor drum 2. Further holes or duct 37 can then be provided, connecting the inside 36 of the rotor drum 2 (or inside of a hollow rotor shaft that is connected to the hollow rotor drum) to lower pressure areas 13 of the engine.

For example, a hole or duct 37 can be provided connecting the inside 36 of the compressor drum 2 to the gap 25. In exemplary embodiments such holes or ducts can be provided in positions of the rotor shaft further downstream, to use the cooling air from the compressor 1 as cooling air for the turbine.

The operation of the compressor in this embodiment is as follows.

The cooling air enters the passages 9 and/or 10 and passes through them cooling the compressor drum 2 and blade roots 7 down. The cooling air enters the circumferential chamber 28, to then enter (via the hole or duct 35) the inside 36 of the compressor drum 2.

From the inside 36 of the compressor, drum 2 the cooling air enters the gap 25 via the hole or duct 37 or other position according to the cooling scheme.

The present disclosure also relates to a method for cooling the compressor of a gas turbine engine.

The method includes making a cooling fluid pass through the longitudinal passages 9, 10 of the blade roots 7 and/or compressor drum 2, to cool them down.

Figure 10:
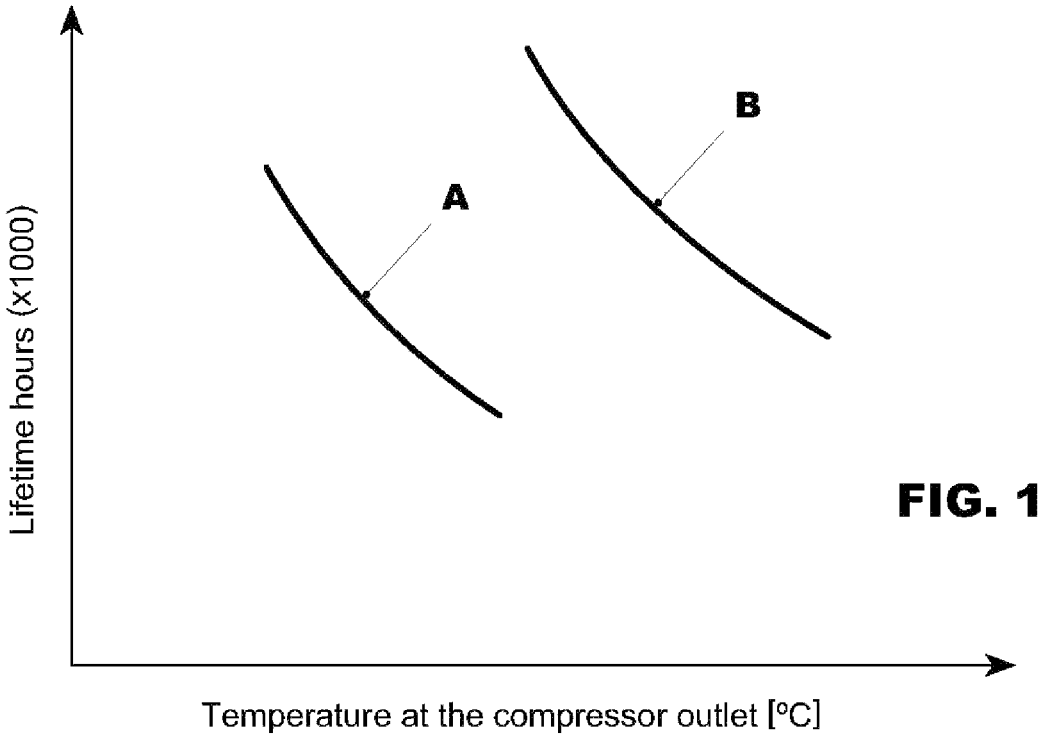
FIG. 10 shows the relationship between lifetime and temperature at the compressor outlet for a known gas turbine engine (curve A) and a gas turbine engine in an exemplary embodiment of the disclosure (curve B).

FIG. 10 shows the dependence of the lifetime of the parts on the temperature at the compressor outlet. Respectively curve A refers to a known gas turbine engine and curve B refers to a gas turbine engine of an exemplary embodiment of the disclosure.

FIG. 10 shows that curve B is shifted towards the high temperatures and, thus, for the same compressor outlet temperature, the engine in the embodiments of the disclosure have a much longer lifetime or, for the same lifetime, the engine in embodiments of the disclosure can operate with a higher temperature, allowing a higher compression degree at the compressor and, thus, larger power generation and higher efficiency than in known gas turbine engines.

The features described may be independently provided from one another.

In practice, the materials used and the dimensions can be chosen at will according to specification, and to the state of the art.

Thus, it will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

Reference Numbers

1 compressor
2 compressor drum
3 compressor rotor blades
5 compressor guide vanes
7 roots of 3
8 seats
9 longitudinal passages of 7
10 longitudinal passages of 2
11 channels of 7
13 higher pressure areas
14 lower pressure areas
15 platform of 3
16 airfoil of 3
18 spacers
19 roots of 18
20 platforms of 18
22 compressed air path
23 channel of 18
25 gap
26 combustion chamber
27 protrusion
28 circumferential chamber
30 engine longitudinal axis
32 bent terminal portion of 9
32*a* portion of 9
33 straight terminal portion of 9
34 locking element
35 hole of 2
36 inside of 2
37 hole of 2
A dependence of the lifetime on the temperature at the compressor outlet for a known gas turbine engine
B dependence of the lifetime on the temperature at the compressor outlet for a gas turbine engine in an exemplary embodiment.

What is claimed is:

1. A gas turbine engine, comprising:

a compressor including a compressor drum and rotor blades having roots connected into seats of the compressor drum, wherein at least one of the rotor blade roots and the compressor drum include longitudinal passages for a cooling fluid, the longitudinal passages connecting higher pressure areas to lower pressure areas of the gas turbine engine;

a gap downstream of the compressor drum for separating the compressor drum from a combustion chamber; and a protrusion provided within the gap to close a compressed air path, wherein the higher pressure areas are defined between the protrusion and the compressed air path.

2. The gas turbine engine as claimed in claim 1, wherein the seats are defined by longitudinal slots into which the blade roots are inserted.

3. The gas turbine engine as claimed in claim 2, wherein the rotor blade roots include the longitudinal passages defined by longitudinal channels provided in the blade roots, wherein channels of blade roots inserted into the same seat are connected together.

4. The gas turbine engine as claimed in claim 3, comprising:

spacers between two adjacent blade roots inserted into the same seat, the spacers having a spacer root and a platform defining, with platforms of the rotor blades, a compressed air path, wherein the spacer roots have longitudinal passages connected to the passages of the blade roots.

5. The gas turbine engine as claimed in claim 1, wherein the lower pressure areas are defined by areas of the gap below the protrusion.

6. The gas turbine engine as claimed in claim 1, wherein the compressor drum is hollow, and the lower pressure areas are defined in the inside of the hollow compressor drum.

7. The gas turbine engine as claimed in claim 1, comprising:

a circumferential chamber extending at an intermediate position of the compressor drum, the circumferential chamber being connected to at least one of the longitudinal passages of the blade roots and to the longitudinal passages of the compressor drum.

8. The gas turbine engine as claimed in claim 3, comprising:

each of the blade roots and compressor drum having longitudinal passages, wherein the longitudinal passages of the blade roots and the longitudinal passages of the rotor drum have axes parallel to an engine longitudinal axis and have a same radial distance from it.

9. The gas turbine engine as claimed in claim 8, wherein the longitudinal passages of the blade roots are connected to the lower pressure areas and the longitudinal passages of the compressor drum are connected to the higher pressure areas.

10. A method for cooling a compressor of a gas turbine engine, including a compressor with rotor blades having roots connected into seats of a compressor drum, the method comprising:

forming at least one of the blade roots and the compressor drum with longitudinal passages for a cooling fluid, the longitudinal passages connecting higher pressure areas to lower pressure areas of the gas turbine engine;

passing a cooling fluid through the longitudinal passages;

forming a gap downstream of the compressor drum for separating the compressor drum from a combustion chamber; and providing a protrusion within the gap for closing a compressed air path, for defining the higher pressure areas between the protrusion and the compressed air path.

11. A gas turbine engine, comprising:

a compressor including a compressor drum and rotor blades having roots connected into seats of the compressor drum, wherein the compressor drum and at least one rotor blade root each include longitudinal passages for a cooling fluid, the longitudinal passages connecting higher pressure areas to lower pressure areas of the gas turbine engine, wherein at least one of the longitudinal passages in the compressor and at least one of the longitudinal passages in the rotor blade roots have an axis parallel to an engine longitudinal axis and have the same radial distance from the axis.

12. The gas turbine engine of claim 11, wherein a compressor drum longitudinal passage is connected to a rotor blade root longitudinal passage, said longitudinal passages being parallel and adjacent in a circumferential direction to one another.

13. The gas turbine engine of claim 11, wherein at least one of the longitudinal passages in the compressor and at least one of the longitudinal passages in the rotor blade roots are connected by a circumferential chamber.

* * * * *